US007279610B2

(12) United States Patent
Cruijsberg et al.

(10) Patent No.: US 7,279,610 B2
(45) Date of Patent: Oct. 9, 2007

(54) METHOD FOR THE PREPARATION OF LOWER OLEFINES BY STEAM CRACKING

(75) Inventors: Emil Eduard Antonius Cruijsberg, Amsterdam (NL); Jeroen Van Westrenen, Amsterdam (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/502,434

(22) PCT Filed: Jan. 24, 2003

(86) PCT No.: PCT/EP03/00790

§ 371 (c)(1),
(2), (4) Date: Sep. 20, 2004

(87) PCT Pub. No.: WO03/062352

PCT Pub. Date: Jul. 31, 2003

(65) Prior Publication Data

US 2005/0148806 A1 Jul. 7, 2005

(30) Foreign Application Priority Data

Jan. 25, 2002 (EP) ..... 02075366

(51) Int. Cl.
*C07C 4/02* (2006.01)
*C10G 9/36* (2006.01)

(52) U.S. Cl. ..... 585/652; 585/648; 585/650; 208/130

(58) Field of Classification Search ..... 585/648, 585/650, 652; 208/130
See application file for complete search history.

(56) References Cited

U.S. PATENT DOCUMENTS

| | | | | |
|---|---|---|---|---|
| 4,361,478 | A | 11/1982 | Gengler et al. | 208/130 |
| 4,579,986 | A | 4/1986 | Sie | 585/324 |
| 4,833,170 | A | 5/1989 | Agee | 518/703 |
| 5,371,308 | A | 12/1994 | Gosselink et al. | 585/251 |

FOREIGN PATENT DOCUMENTS

| | | |
|---|---|---|
| EP | 0084151 | 7/1983 |
| EP | 0253633 | 1/1988 |
| EP | 1468061 | 11/2005 |
| NL | 7712952 | 5/1979 |
| WO | WO9856877 | 12/1998 |
| WO | 01/66672 | 9/2001 |

OTHER PUBLICATIONS

Oil and Gas Jrnl., Sep. 6, 1971, pp. 86-90 "Partial Oxidation Grows Stronger in U.S.", C.J. Kuhre, et al.
International Search Report dated Sep. 2, 2003.
Ullman's Encyclopedia of Industrial Chemistry - Fifth completely revised edition, vol. A 10: Ethanolamines to Fibers, 4. Synthetic Organic (Year Unknown).

*Primary Examiner*—Glenn Caldarola
*Assistant Examiner*—In Suk Bullock

(57) ABSTRACT

A method for the preparation of lower olefins by steam cracking, wherein the feed containing heavy hydrocarbons obtained by Fischer-Tropsch synthesis is subjected to steam cracking in a naphtha designed steam cracking furnace for steam cracking the Fischer-Tropsch hydrocarbons into the lower olefins.

6 Claims, No Drawings

METHOD FOR THE PREPARATION OF LOWER OLEFINES BY STEAM CRACKING

FIELD OF THE INVENTION

The present invention relates to a method for the preparation of lower olefins by steam cracking of heavy hydrocarbons obtained by Fischer-Tropsch synthesis in a naphtha designed steam cracking furnace.

BACKGROUND OF THE INVENTION

In U.S. Pat. No. 4,833,170 a process is described for the production of heavier hydrocarbons from one or more gaseous light hydrocarbons. Such hydrocarbons may be used as gas oil.

SUMMARY OF THE INVENTION

The present invention relates to the use of such heavy Fischer-Tropsch hydrocarbons for the preparation of lower olefins. For such preparation, according to the invention, use is made of a new or available steam cracking furnace that is designed for steam cracking of a naphtha feed. Furnaces which are designed for a petroleum derived naphtha feed cannot be used for a more heavy petroleum derived feed because such a more heavy feed will not fully evaporate in the pre-heating sections of the furnace resulting in excessive coke formation in especially the superheating section of the pre-heater. Although naphtha and Fischer-Tropsch heavy hydrocarbons have different compositions, and different boiling point ranges, a naphtha designed steam cracking furnace is suitable for steam cracking the more heavy Fischer-Tropsch hydrocarbons. Accordingly, these heavy Fischer-Tropsch hydrocarbons may be used according to the invention for the preparation of lower olefins by steam cracking. Due to the difference in composition of the heavy Fischer-Tropsch hydrocarbons in comparison to naphtha, the lower olefins produced by steam cracking comprise less aromatic compounds and thus for producing the same amount of lower olefins less feed is required. In addition, relative to steam cracking of naphtha, steam cracking of Fischer-Tropsch heavy hydrocarbons results in an increased production of ethene, propene, butene and a lower production of hydrogen, methane and carbon monoxide.

DETAILED DESCRIPTION OF THE INVENTION

Accordingly, the present invention provides a method for the preparation of lower olefins ethene, propene and butene by steam cracking, wherein the feed comprising heavy hydrocarbons obtained by Fischer-Tropsch synthesis, which Fischer-Tropsch hydrocarbons have an initial boiling point of above 150° C. and a final boiling point of below 400° C., is subjected to steam cracking in a naphtha designed steam cracking furnace for steam cracking the Fischer-Tropsch hydrocarbons into the lower olefins.

Preferably, the steam cracking of Fischer-Tropsch heavy hydrocarbons is carried out in a conventional naphtha designed steam cracking furnace comprising a convection zone provided with a first preheating zone in which the Fischer-Tropsch feed is heated, a second preheating zone in which the heated Fischer-Tropsch hydrocarbons are heated in the presence of steam to form a mixture of liquid and gaseous Fischer-Tropsch hydrocarbons; and a super heating zone in which the liquid and gaseous Fischer-Tropsch hydrocarbons are super heated; and a cracking zone in which the gaseous super heated Fischer-Tropsch hydrocarbons are steam cracked into the lower olefins ethene, propene and butene.

For the purposes of this invention a petroleum derived naphtha is defined as the fraction starting at $C_5$ to a final boiling point of between 170-230° C.

The initial and final boiling point of naphtha are lower than the initial and final boiling point of the heavy Fischer-Tropsch hydrocarbons, therefore the feed to the second preheating zone may not be only a gas but may still be a mixture of gas and liquid.

Generally, the feed for the second preheating zone comprises less than 50 wt. % liquid Fischer-Tropsch hydrocarbons. Preferably this feed comprises less than 25 wt. % or more preferably less than 10 wt. % liquid Fischer-Tropsch hydrocarbons. Leaving the second preheating step the Fischer-Tropsch hydrocarbons are generally in the gas phase.

The cracking of the heavy Fischer-Tropsch hydrocarbons is carried out in the presence of steam and optionally in the presence of additional dilution gas. Generally, the weight ratio of steam to Fischer-Tropsch hydrocarbons is 0.4-0.8, preferably 0.5-0.75, more preferably 0.60-0.70.

Generally, the Fischer-Tropsch hydrocarbons used as a feed for steam cracking in the naphtha designed steam cracking furnace have an initial boiling point of above 100° C., preferably above 150° C., more preferably above 200° C., and a final boiling point of below 400° C., preferably below 380° C., more preferably below 360° C.

Generally, these Fischer-Tropsch heavy hydrocarbons comprise more than 75 wt. % n-paraffins and preferably more than 80 wt. %. These n-paraffins generally have a carbon number of 5-25, preferably of 7-23, more preferably of 10-20.

The Fischer-Tropsch hydrocarbons to be used as a feed according to the invention may be directly obtained by the Fischer-Tropsch synthesis or indirectly after further treatment. Such a treatment may comprise fractional distillation of hydrocarbons originating from the Fischer-Tropsch synthesis. Such fractional distillation may be carried out at temperatures of 100-380° C., preferably at 150-370° C., and more preferably at 200-360° C. Another pretreatment comprises hydro cracking or thermal cracking of Fischer-Tropsch hydrocarbons, which hydro cracking or thermal cracking provides the heavy Fischer-Tropsch hydrocarbons as described above.

Preferably, the heavy Fischer-Tropsch hydrocarbons that they are essentially free of aromatic compounds, nitrogen comprising compounds and sulfur comprising compounds.

The Fischer-Tropsch heavy hydrocarbons to be used according to the invention as a feed for steam cracking in a naphtha designed steam cracking furnace for the production of lower olefines, are produced in a Fischer-Tropsch synthesis. Fischer-Tropsch synthesis of hydrocarbons is a well known process. In the Fischer-Tropsch synthesis the starting material is a hydrocarbonaceous feed.

The hydrocarbonaceous feed suitably is methane, natural gas, associated gas or a mixture of $C_{1-4}$ hydrocarbons. The feed comprises mainly, that is, more than 90 v/v %, especially more than 94%, $C_{1-4}$ hydrocarbons, especially comprises at least 60 v/v percent methane, preferably at least 75 percent, more preferably 90 percent. Very suitably, natural gas or associated gas is used. Suitably, any sulfur in the feedstock is removed.

The partial oxidation of this hydrocarbonaceous feed, producing mixtures of especially carbon monoxide and hydrogen, can take place according to various established processes. These processes include the Shell Gasification Process. A comprehensive survey of this process can be found in the Oil and Gas Journal, Sep. 6, 1971, pp 86-90.

The oxygen containing gas is air (containing about 21 vol. percent of oxygen), oxygen enriched air, suitably containing up to 70 percent, or substantially pure air, containing typically at least 95 vol. % oxygen. Oxygen or oxygen enriched air may be produced via cryogenic techniques, but could also be produced by a membrane based process, e.g. the process as described in WO 93/06041. The boiler provides the power for driving at least one air compressor or separator of the air compression/separating unit.

To adjust the $H_2$/CO ratio in the syngas, carbon dioxide and/or steam may be introduced into the partial oxidation process. Preferably up to 15% volume based on the amount of syngas, preferably up to 8% volume, more preferably up to 4% volume, of either carbon dioxide or steam is added to the feed. Water produced in the hydrocarbon synthesis may be used to generate the steam. As a suitable carbon dioxide source, carbon dioxide from the effluent gasses of the expanding/combustion step may be used. The $H_2$/CO ratio of the syngas is suitably between 1.5 and 2.3, preferably between 1.8 and 2.1. If desired, (small) additional amounts of hydrogen may be made by steam methane reforming, preferably in combination with the water shift reaction. Any carbon monoxide and carbon dioxide produced together with the hydrogen may be used in the hydrocarbon synthesis reaction or recycled to increase the carbon efficiency. Additional hydrogen manufacture may be an option.

The percentage of hydrocarbonaceous feed which is converted in the first step of the process of the invention is suitably 50-99% by weight and preferably 80-98% by weight, more preferably 85-96% by weight.

The gaseous mixture, comprising predominantly hydrogen, carbon monoxide and optionally nitrogen, is contacted with a suitable catalyst in the catalytic conversion stage, in which the hydrocarbons are formed. Suitably at least 70 v/v % of the syngas is contacted with the catalyst, preferably at least 80%, more preferably at least 90, still more preferably all the syngas.

The catalysts used for the catalytic conversion of the mixture comprising hydrogen and carbon monoxide are known in the art and are usually referred to as Fischer-Tropsch catalysts. Catalysts for use in the Fischer-Tropsch hydrocarbon synthesis process frequently comprise, as the catalytically active component, a metal from Group VIII of the Periodic Table of Elements. Particular catalytically active metals include ruthenium, iron, cobalt and nickel. Cobalt is a preferred catalytically active metal.

The catalytically active metal is preferably supported on a porous carrier. The porous carrier may be selected from any of the suitable refractory metal oxides or silicates or combinations thereof known in the art. Particular examples of preferred porous carriers include silica, alumina, titania, zirconia, ceria, gallia and mixtures thereof, especially silica and titania. The amount of catalytically active metal on the carrier is preferably in the range of from 3 to 300 pbw per 100 pbw of carrier material, more preferably from 10 to 80 pbw, especially from 20 to 60 pbw.

If desired, the catalyst may also comprise one or more metals or metal oxides as promoters. Suitable metal oxide promoters may be selected from Groups IIA, IIIB, IVB, VB and VIB of the Periodic Table of Elements, or the actinides and lanthanides. In particular, oxides of magnesium, calcium, strontium, barium, scandium, yttrium. lanthanum, cerium, titanium, zirconium, hafnium, thorium, uranium, vanadium, chromium and manganese are most suitable promoters. Particularly preferred metal oxide promoters for the catalyst used to prepare the hydrocarbons for use in the present invention are manganese and zirconium oxide. Suitable metal promoters may be selected from Groups VIIB or VIII of the Periodic Table. Rhenium and Group VIII noble metals are particularly suitable, with platinum and palladium being especially preferred. The amount of promoter present in the catalyst is suitably in the range of from 0.01 to 100 pbw, preferably 0.1 to 40, more preferably 1 to 20 pbw, per 100 pbw of carrier.

The catalytically active metal and the promoter, if present, may be deposited on the carrier material by any suitable treatment, such as impregnation, kneading and extrusion. After deposition of the metal and, if appropriate, the promoter on the carrier material, the loaded carrier is typically subjected to calcination at a temperature of generally from 350° C. to 750° C., preferably a temperature in the range of from 450° C. to 550° C. The effect of the calcination treatment is to remove crystal water, to decompose volatile decomposition products and to convert organic and inorganic compounds to their respective oxides. After calcination, the resulting catalyst may be activated by contacting the catalyst with hydrogen or a hydrogen-containing gas, typically at temperatures of about 200°C. to 350° C.

The catalytic conversion process may be performed under conventional synthesis conditions known in the art. Typically, the catalytic conversion may be effected at a temperature in the range of from 100° C. to 600° C., preferably from 150° C. to 350° C., more preferably from 180° C. to 270° C. Typical total pressures for the catalytic conversion process are in the range of from 1 to 200 bar absolute, more preferably from 10 to 70 bar absolute. In the catalytic conversion process mainly (at least 70 wt %), preferably 90 wt % of $C_5$+ hydrocarbons are formed.

Preferably, a Fischer-Tropsch catalyst is used, which yields substantial quantities of normal (and also iso-) paraffins, more preferably substantially normal paraffins. A part may boil above the boiling point range of heavy hydrocarbons to normally solid hydrocarbons. A most suitable catalyst for this purpose is a cobalt-containing Fischer-Tropsch catalyst. The term heavy hydrocarbons as used herein, is a reference to hydrocarbon mixtures of which the boiling point range corresponds substantially to that of kerosene and gas oil fractions obtained in a conventional atmospheric distillation of crude mineral oil. The boiling point range of these heavy hydrocarbons (also called middle distillates) generally lies within the range of about 100-380° C., preferably 200-370° C., more preferably 150-360° C.

The Fischer-Tropsch hydrocarbons generally comprise $C_4$-$C_{100}$, preferably $C_4$-$C_{50}$ hydrocarbons. Normally liquid Fischer-Tropsch hydrocarbons are suitably $C_{5-25}$ hydrocarbons, especially $C_{7-23}$ hydrocarbons, more especially $C_{10-20}$ hydrocarbons, or mixtures thereof These hydrocarbons or mixtures thereof are liquid at temperatures between 5° C. and 30° C. (1 bar), especially at about 20° C. (1 bar), and usually are paraffinic in nature, while up to 24 wt %, preferably up to 12 wt %, of either olefins or oxygenated compounds may be present. Depending on the catalyst and the process conditions used in the Fischer Tropsch reaction, normally gaseous hydrocarbons, normally liquid hydrocarbons and optionally normally solid hydrocarbons are obtained. It is preferred to obtain a large fraction of normally solid hydrocarbons. These solid hydrocarbons may be obtained up to 85 wt % based on total hydrocarbons, usually between 50 and 75 wt %.

The higher boiling range paraffinic hydrocarbons may be subjected to a catalytic hydrocracking step or thermal cracking, which are known per se in the art, to yield the desired heavy hydrocarbons. The catalytic hydro-cracking is carried out by contacting the paraffinic hydrocarbons at elevated temperature and pressure and in the presence of hydrogen with a catalyst containing one or more metals having hydrogenation activity, and sup-ported on a carrier. Suitable hydrocracking catalysts include catalysts comprising metals selected from Groups VIB and VIII of the Periodic Table of Elements. Preferably, the hydrocracking catalysts contain one or more noble metals from group VIII. Preferred noble metals are platinum, palladium, rhodium, ruthenium, iridium and osmium. Most preferred catalysts for use in the hydro-cracking stage are those comprising platinum.

The amount of catalytically active metal present in the hydrocracking catalyst may vary within wide limits and is typically in the range of from about 0.05 to about 5 parts by weight per 100 parts by weight of the carrier material.

Suitable conditions for the catalytic hydrocracking are known in the art. Typically, the hydrocracking is effected at a temperature in the range of from about 175 to 400° C. Typical hydrogen partial pressures applied in the hydrocracking process are in the range of from 10 to 250 bar.

The process may be operated in a single pass mode ("once through") or in a recycle mode. The process may be carried out in one or more reactors, either parallel or in series. In the case of small hydro-carbonaceous feedstock streams, the preference will be to use only one reactor. Slurry bed reactors, ebulliating bed reactors and fixed bed reactors may be used, the fixed bed reactor being the preferred option.

The production of lower olefins, in particular ethene and propene, is in general achieved by pyrolyzing the heavy Fischer-Tropsch hydrocarbons.

Pyrolysis is also called steam cracking and comprises thermal cracking of these hydrocarbons in the presence of steam and if desired a dilution gas. The process comprises a convection zone, a cracking zone, a cooling zone and a separation zone. The pyrolysis furnace comprises the convection zone and the cracking zone. The convection zone comprises a first preheating zone and a second preheating zone. Generally, feed is heated in the first preheating zone, and dilution gas is added to the feed before the (liquid and gas) mixture of feed and dilution gas is sent to the second preheating zone.

Naphtha furnaces designed for treating a naphtha feed will have a larger heat transfer surface area in the first preheating zone than furnaces designed for light feed, as a heavy feed will have a higher initial boiling point than light feed and the main aim of the first preheating zone is vaporizing and heating the feed.

A furnace designed for treating gaseous feed will have a smaller heat transfer surface area in the first preheating zone than a furnace designed for liquid feed, as a gaseous feed does not need to be vaporized. It is to be understood that the scope of the steam cracking process may include any number and type of process steps between each described process step or between a described source and destination within a process step.

Usually and preferably, all of the product of a process step will be subjected to the next process step. However, it is possible to send only part of the product of a process step to the next process step.

Feed may be introduced into the process at further inlets other than the standard inlet and the inlet where feed is introduced together with steam and/or dilution gas. However, it is preferred to introduce feed only at the standard inlet of the convection zone and further feed together with steam and/or dilution gas.

Dilution gas may be added at a single inlet, or may be added via several inlets. However, it is preferred to add dilution gas at a single inlet.

The temperatures mentioned in this specification are the temperatures which the feed attains.

The initial boiling point of naphtha may be from 0° C. to 100° C. while final boiling points may range of from 90° C. to 250° C. The initial and final boiling points ranges of the Fischer-Tropsch hydrocarbons are shifted to higher temperatures.

The convection zone generally comprises a first preheating zone and a second preheating zone between which is located an inlet for steam and optionally dilution gas. In the first preheating zone, the feed is heated. After the first preheating zone, steam and optionally dilution gas is added to the feed and the mixture obtained may be heated further in the second preheating zone to a temperature just below the temperature at which cracking starts to occur. The temperature of the product obtained from the convection zone will usually be from 400° C. to 800° C., depending upon the feed, more specifically from 450° C. to 750° C.

The pyrolysis furnace may be any type of conventional olefins pyrolysis furnace designed for pyrolizing heavy feed and operated for production of lower boiling products such as olefins, especially including a tubular steam cracking furnace. The tubes within the convection zone of the pyrolysis furnace may be arranged as a bank of tubes in parallel, or the tubes may be arranged for a single pass of the feedstock through the convection zone. Within each bank, the tubes may arranged in a coil or serpentine type arrangement. At the inlet, the feed may be split among several tubes, or may be fed to one single pass tube through which all the feed flows from the inlet to the outlet of the first stage preheater. Preferably, the first and/or second preheating zone of the convection zone comprise a multiple pass tubular reactor in which feed is passed through the first and/or the second preheating zone via more than one tube. Multiple pass tubular reactors often contain tubes having connections at their ends leading feed from the one tube to the next tube until the feed is sufficiently heated to be mixed with dilution gas and be passed to the second preheating zone, or to be sent to the cracking zone.

The pressure and temperature at which the feed is fed to the inlet of the first preheating zone is not critical, typically the temperature will be from 0° C. to 300° C.

The optimal temperature to which the feed is heated in the first preheating zone will depend upon the pressure of the feed, and the performance and operation of the remainder of the process. The product of the first preheating zone will generally have an exit temperature of at least 150° C. such as 195° C. The upper range on the temperature of the feed in the first preheating zone is limited to the point at which the stability of the feed is impaired. At a certain temperature, the coking propensity of the feed increases. This temperature limit would apply to both the first and the second preheating zone and all tubes in these zones. Preferably, the exit temperature of the feed within the first preheating zone is not more than 520° C., and most preferably not more than 500° C.

The heating elements in the first and second preheating zone in the convection zone is typically a bank of tubes, wherein the contents in the tubes are heated primarily by convective heat transfer from the combustion gas exiting from the cracking zone of the pyrolysis furnace, so-called flue gas. However, different heating elements may be used as well.

The pressure within the first and second preheating zone is not particularly limited. The pressure is generally within a range of from 4 to 21 bar, more preferably from 5 to 13 bar.

In the process of the present invention, part of the heavy hydrocarbon feed obtained by Fischer-Tropsch synthesis may be introduced via the standard feed inlet of the convection zone, and if desired, part of the feed may be introduced further downstream in the convection zone.

Steam gas is added to the convection zone. This can be done preferably in or before the second preheating zone of the convection zone. Other dilution gas is preferably added at a point external to the pyrolysis furnace for ease of maintaining and replacing equipment.

The dilution gas is a vapor at the injection point into the convection zone. Examples of dilution gases are methane, ethane, nitrogen, hydrogen, natural gas, dry gas, refinery off gases, and a vaporized naphtha. Preferably, the steam is superheated steam.

Typical dilution gas temperatures at the dilution gas/feed junction range from 140° C. to 800° C., more preferably of from 150° C. to 780° C., more preferably from 200° C. to 750° C.

The pressure of dilution gas is not particularly limited, but is preferably sufficient to allow injection. Typical dilution gas pressures added to the feed generally range from 6 to 15 bar.

It is desirable to add steam and optionally dilution gas between the first preheating zone and the second preheating zone in an amount which will generally not be more than 1 kg of dilution gas per kg of feed. However, there may be circumstances in which a higher amount of dilution gas may be advantageous.

The mixture of dilution gas and feed is fed to the second preheating zone where the mixture is heated further. The mixture generally comprises not more than 50 wt. % liquid Fischer-Tropsch hydrocarbons. Preferably not more than 25 wt. %, most preferably not more than 10 wt. % Tubes of the second preheating zone can be heated by the flue gases from the cracking zone of the furnace. In the second preheating zone (super heater), the mix is fully preheated to near or just below a temperature at which substantial feedstock cracking and associated coke laydown in the preheater would occur such as 450 to 550° C., preferably 460-500° C., such as 490° C.

Subsequently, the product of the convection zone is sent to the cracking zone. The temperature of the mixture of steam and feed is increased further under controlled residence time, temperature profile and partial pressure. The exit temperature of the product obtained in the cracking zone is generally from 700° C. to up to 1000° C. more specifically of from 750° C. to 950° C. The pressure is generally within a range of from 2 bar to 25 bar, more preferably of from 3 bar to 18 bar.

The reactions in the cracking zone are highly endothermic, and therefore a high rate of energy input is needed.

On leaving the cracking zone, the products are generally immediately cooled. The temperature of the product will usually be reduced to a temperature of from 200° C. to 700° C., more specifically of from 250° C. to 650° C. to prevent degradation by secondary reactions. Cooling of the product obtained in the cracking zone may be done in any way suitable, such as by direct quenching or indirect quenching.

The cooled product is subsequently separated into the desired end-products. Separation of the desired end-products may start at cooling where heavy components can be removed. Further, during cooling, the gas obtained may be compressed, and acids and water removed. Subsequently, the product may be dried, and uncracked feed, ethane and propane may be recovered for recycling as pyrolysis feed. The cracking severity affects the composition of the product obtained.

Products of an olefins pyrolysis furnace include, but are not limited to, ethene, propane, butadiene, benzene, hydrogen, and methane, and other associated olefinic, paraffinic, and aromatic products. Ethene generally is the predominant product, typically ranging from 15 to 60% wt, based on the weight of the feed.

In a typical work-up, the product of the cracking zone is cooled with the help of a water quench, followed by multistage compression typically in 4 to 6 stages. Before the last compressor stage, the gas may be treated with caustic to remove hydrogen sulphide and carbon dioxide. Actetylenes may be hydrogenated with hydrogen-rich compressor gas. After the last compression stage, the cracked gas is typically dehydrated by chilling and dried by use of molecular sieves. Methane and hydrogen may be removed in a demethanizer. In a demethanizer, the hydrocarbons containing 2 carbon atoms are produced overhead and the hydrocarbons containing 3 carbon atoms or more are is a bottom product. The overhead stream may be hydrogenated to remove acetylene and then fractionated to produce ethene and ethane. The ethane may be recycled. The bottom product may be further fractionated, if appropriate, to remove heavy ends including compounds containing 4 carbon atoms or more. The overhead stream from a depropanizer may be hydrogenated to remove methylacetylene and propadiene, which can be recovered for sale or removed via other means. Propene may be obtained as overhead stream from the depropanizer, and the bottom propane fraction may be recycled.

Any percentage mentioned in this description is calculated on total weight or volume of the composition, unless indicated otherwise. When not mentioned, percentages are considered to be weight percentages. Pressures are indicated in bar absolute, unless otherwise indicated.

We claim:

1. A method for the preparation of ethene, propene and butene by steam cracking comprising: subjecting a feed comprising heavy hydrocarbons obtained by Fischer-Tropsch synthesis, which Fischer-Tropsch hydrocarbons have an initial boiling point of above 150° C. and a final boiling point of below 400° C., to steam cracking in a naphtha designed steam cracking furnace, wherein the furnace comprises a convection zone provided with a first preheating zone in which the Fischer-Tropsch feed is heated, a second preheating zone in which the heated Fischer-Tropsch hydrocarbons are heated in the presence of steam to form a mixture of liquid and gaseous Fischer-Tropsch hydrocarbons; and a super heating zone in which the liquid and gaseous Fischer-Tropsch hydrocarbons are super heated; and a cracking zone in which the gaseous super heated Fischer-Tropsch hydrocarbons are steam cracked into ethene, propene and butene.

2. The method of claim 1, wherein the feed for the second preheating zone comprises less than 50 wt. %, liquid Fischer-Tropsch hydrocarbons.

3. The method of claims 1, wherein the weight ratio of steam to Fischer-Tropsch hydrocarbons is 0.4-0.8.

4. The method of claims 1, wherein the Fischer-Tropsch hydrocarbons comprise more than 75 wt. % n paraffins.

5. The method of claim 4, wherein the n-paraffins have a carbon number of 10-20.

6. The method of claim 1, wherein the Fischer-Tropsch hydrocarbons are essentially free of aromatic compounds, nitrogen compounds and/or sulfur compounds.

* * * * *